US005328258A

United States Patent [19]

Scalise

[11] Patent Number: 5,328,258

[45] Date of Patent: Jul. 12, 1994

[54] PIZZA BOX STORAGE AND DISPENSING ASSEMBLY

[76] Inventor: Guy G. Scalise, 22 Oakland Sq., Pittsburgh, Pa. 15213

[21] Appl. No.: 941,729

[22] Filed: Sep. 8, 1992

[51] Int. Cl.[5] ..... A47F 1/00

[52] U.S. Cl. ..... 312/42; 312/319.1; 221/298

[58] Field of Search ..... 312/42, 50, 45, 319.1; 221/298, 288, 299, 300, 241, 242

[56] References Cited

U.S. PATENT DOCUMENTS

| | | | |
|---|---|---|---|
| 2,868,603 | 1/1959 | Wilkinson | 312/42 |
| 3,055,293 | 9/1962 | Lariccia | 312/45 |
| 3,210,140 | 10/1965 | Smythe | 312/42 |
| 3,352,614 | 11/1967 | Anderson | 312/42 |
| 3,502,382 | 3/1970 | Rainey | 312/42 |
| 3,744,866 | 7/1973 | Cook | 312/42 |
| 4,512,707 | 4/1985 | Dines | 312/42 |
| 4,769,573 | 9/1988 | Celik | 312/42 |

FOREIGN PATENT DOCUMENTS

| | | | |
|---|---|---|---|
| 2144812 | 3/1976 | Fed. Rep. of Germany | 312/42 |
| 3220617 | 12/1983 | Fed. Rep. of Germany | 221/298 |

*Primary Examiner*—Flemming Saether

*Attorney, Agent, or Firm*—Paul Bogdon; Scalise, Nancy M.

[57] ABSTRACT

A pizza box storage and dispensing assembly is disclosed. The assembly includes a pair of telescoping enclosures of generally rectangular cross-sectional outlines sized to snugly receive stacked pizza boxes. The enclosures have rear sections, side walls or sections, and front sections with the front section of the lower enclosure being provided with a dispensing opening at its lower end dimensioned to permit grasping and withdrawal of a single pizza box therethrough. A plate with parallel risers on its sides is fixed to lower sections of the sidewalls of the lower enclosure and extends rearwardly and upwardly from the lower end of the dispensing opening to a lower portion of the rear section of the lower enclosure. Upper and lower restraining paddles are disposed in both sidewalls of the lower enclosure with the lower paddles connected with springs urging them inwardly and the upper paddles interconnected with rods with a lower rods arranged adjacent the plate to be engaged by the lowermost pizza box to transmit a force through the rods to urge the paddle inwardly from the sidewall to thereby restrain downward movement of the pizza boxes at and above the upper paddle. Withdrawal of the lowermost pizza box releases the force allowing the paddle to return against the sidewall and allowing the pizza boxes to slide downwardly while urging the lower paddles inwardly against the force of the springs.

8 Claims, 3 Drawing Sheets

PIZZA BOX STORAGE AND DISPENSING ASSEMBLY

BACKGROUND OF THE INVENTION

This invention relates to a pizza box storage and dispensing assembly.

Restaurants which prepare pizzas ordinarily provide for take-out or delivery of the pizzas to consumers. Cartons or boxes of well-known configuration are used for the take-out pizzas. Boxes ready to be filled with prepared pizzas are stacked at some location in the kitchen of the restaurant. A common place to stack the pizza boxes is on shelving above a table where the pizzas are prepared or brought to when they are done baking. Most often the stack of pizza boxes extends to a height well above the maximum reach of the kitchen personnel. A pizza box to be filled is of necessity drawn out from the lower or middle section of the stack. The weight of the pizza boxes above the one sought to be removed for use makes removal difficult sometimes causing the upper boxes to be toppled over as a lower box is removed.

This invention overcomes the problems inherent in storing pizza boxes for anticipated use by providing a pizza box storage and dispensing assembly which allows for orderly storage of pizza boxes and easy retrieval of a single pizza box for filling with a pizza. Pizza boxes are easily placed in the assembly which may be telescopic in form to vary the storage space for the boxes. The lowermost pizza box within the assembly is exposed to be readily removed when needed. Upon removal of the lowermost pizza box the upper boxes shift downwardly positioning a new box for removal. The stored pizza boxes are in a stable stacked arrangement and will not be toppled during removal of the lowermost box. The advantage of ease of removal of the lowermost box and stable storage are provided by a structure which is simple in design and thus economical to produce.

SUMMARY OF THE INVENTION

This invention provides a pizza storage and dispensing assembly which preferably comprises: an upright, hollow enclosure of generally rectangular cross-section having an interconnected back section, sidewalls, and front section, all of which are sized and shaped such that typical pizza boxes of predetermined rectangular or square sizes may be slidably received within the enclosure; the sidewalls and front section of the enclosure defining a dispensing opening at the lower end of the enclosure dimensioned to permit grasping and withdrawal of a single pizza box therethrough; a plate fixed between lower portions of the sidewalls extending at an inclination from the lower end of the dispensing opening upwardly and rearwardly to a lower portion of the back section; and restraining means disposed at a horizontal plane through an intermediate portion of at least one of the sidewalls and responsive to the weight of a lowermost pizza box on the plate member for urging a force on pizza boxes above the lowermost pizza boxes for restraining downward movement of pizza boxes above the horizontal plane and for releasing the restraining force upon withdrawal of the lowermost pizza box from the enclosure. The inclined plate may be provided with parallel elongated risers on its sides to slightly elevate a pizza box above the surface of the plate, to thereby facilitate removal of the lowermost pizza box from the enclosure. The enclosure may be formed of telescoping upper and lower sections whereby the pizza box storage area may be increased as desired. The restraining means is intended to hold the upper pizza boxes from downward movement when the lowermost box is in position for removal, and thereby keeping the weight of the upper boxes off the lowermost box thereby also facilitating removal of the lowermost box. The restraining means may be an interconnected paddle and rod arrangement with the paddle ordinarily urged inwardly of the sidewall and away from contact with the adjacent pizza box, except when the lowermost box is on the plate whereby that lowermost box engages a section of rod to transmit a force to the paddle to urge it inwardly into contact with the adjacent box to thereby restrain the upper boxes against downward movement. A pair of restraining means may be arranged in the enclosure on each side thereof, if so desired. In addition, the inclined plate may be arranged to hold the sidewalls together, and to be removed and replaced with a smaller or larger similarly shaped plate to thereby vary the cross-sectional area of the enclosure to thereby accommodate different sizes of pizza boxes. The sidewalls may also define the back and rear sections so long as a rectangular or square cross-sectional enclosure is formed for holding the pizza boxes in place. The sidewalls may be simply detached for ease of shipping, storing, and cleaning. This invention allows effective storage of pizza boxes and simple, efficient removal of the conveniently located lowermost box which after its removal results in the other boxes moving downwardly within the enclosure.

Various other advantages, details, and modifications of this invention will become apparent as the following description of a certain present preferred embodiment proceeds.

DESCRIPTION OF THE DRAWING

In the accompanying drawings I show a certain present preferred embodiment of this invention in which.

DESCRIPTION OF A PREFERRED EMBODIMENT

Figure 1:
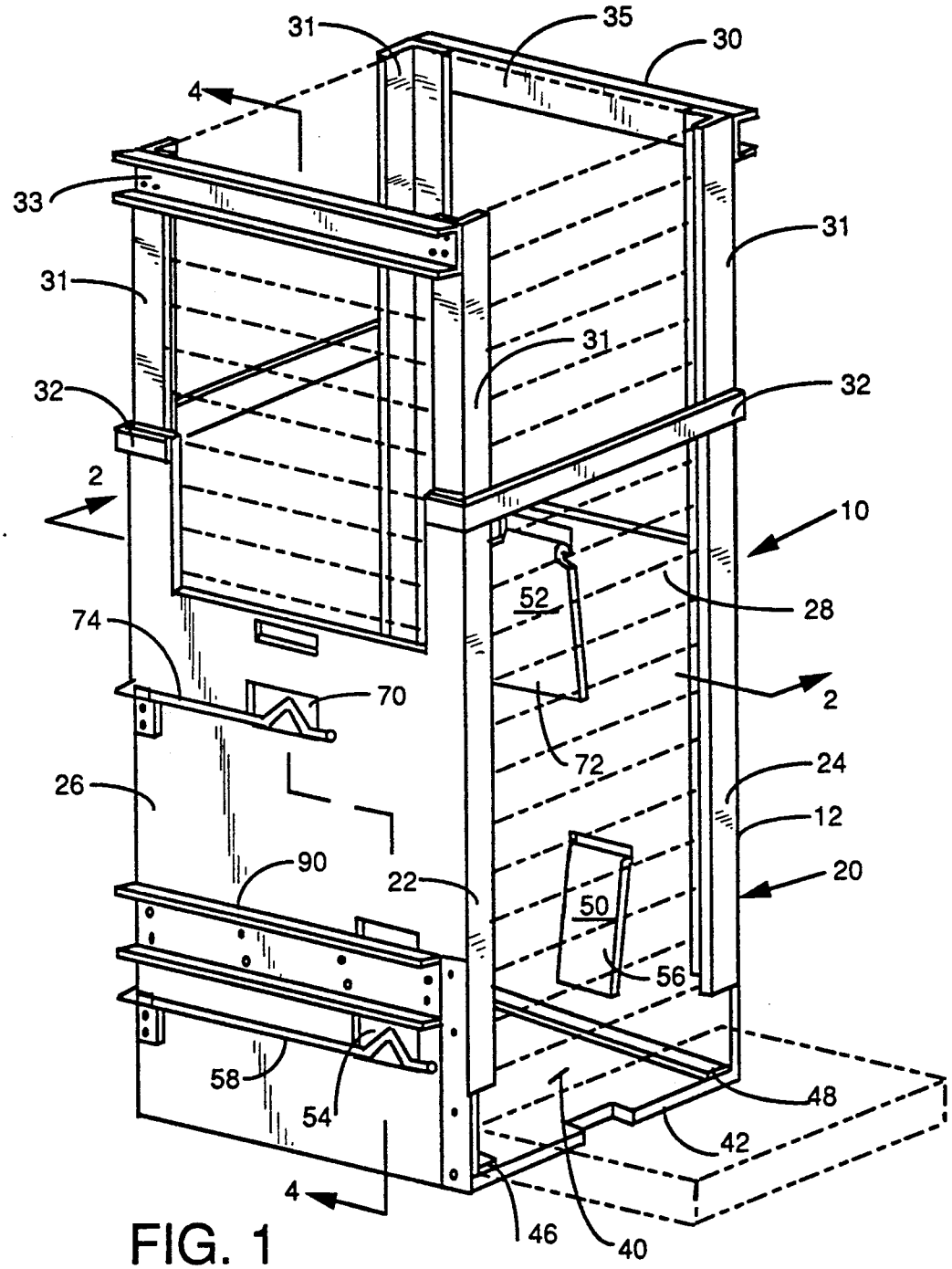
FIG. 1 is a perspective view of a pizza box storage and dispensing assembly embodying the present invention.
Figure 2:
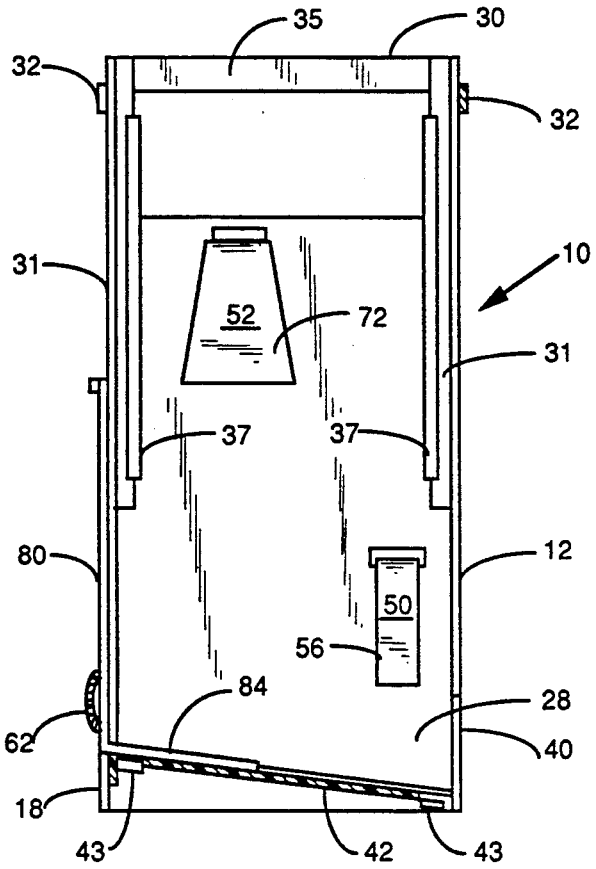
FIG. 2 is a horizontal section view through the front and rear of the assembly of FIG. 1 showing more details of construction.
Figure 3:
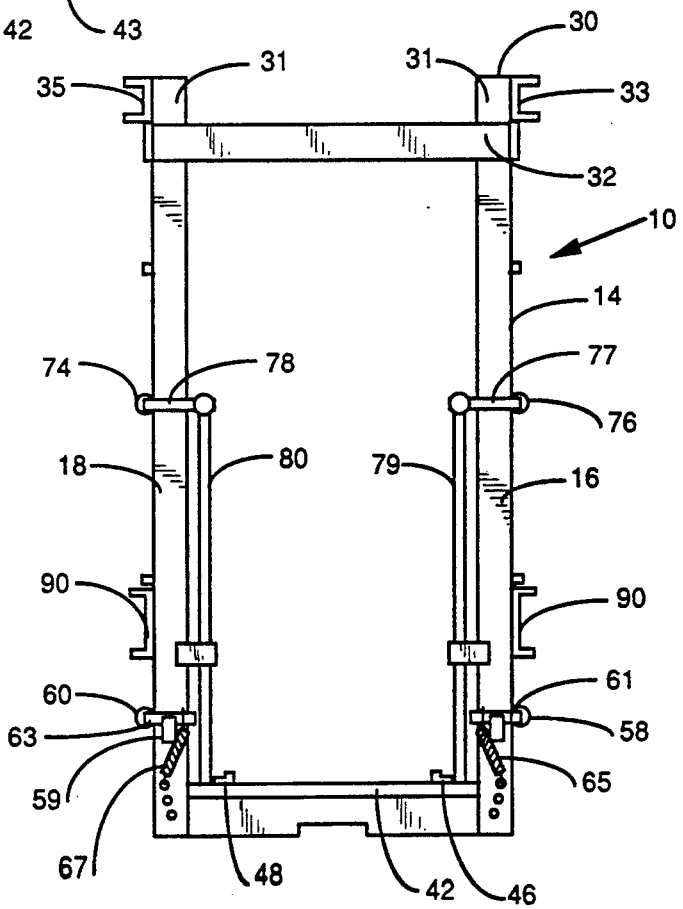
FIG. 3 is a rear elevation view of the assembly of FIG. 1.
Figure 4:
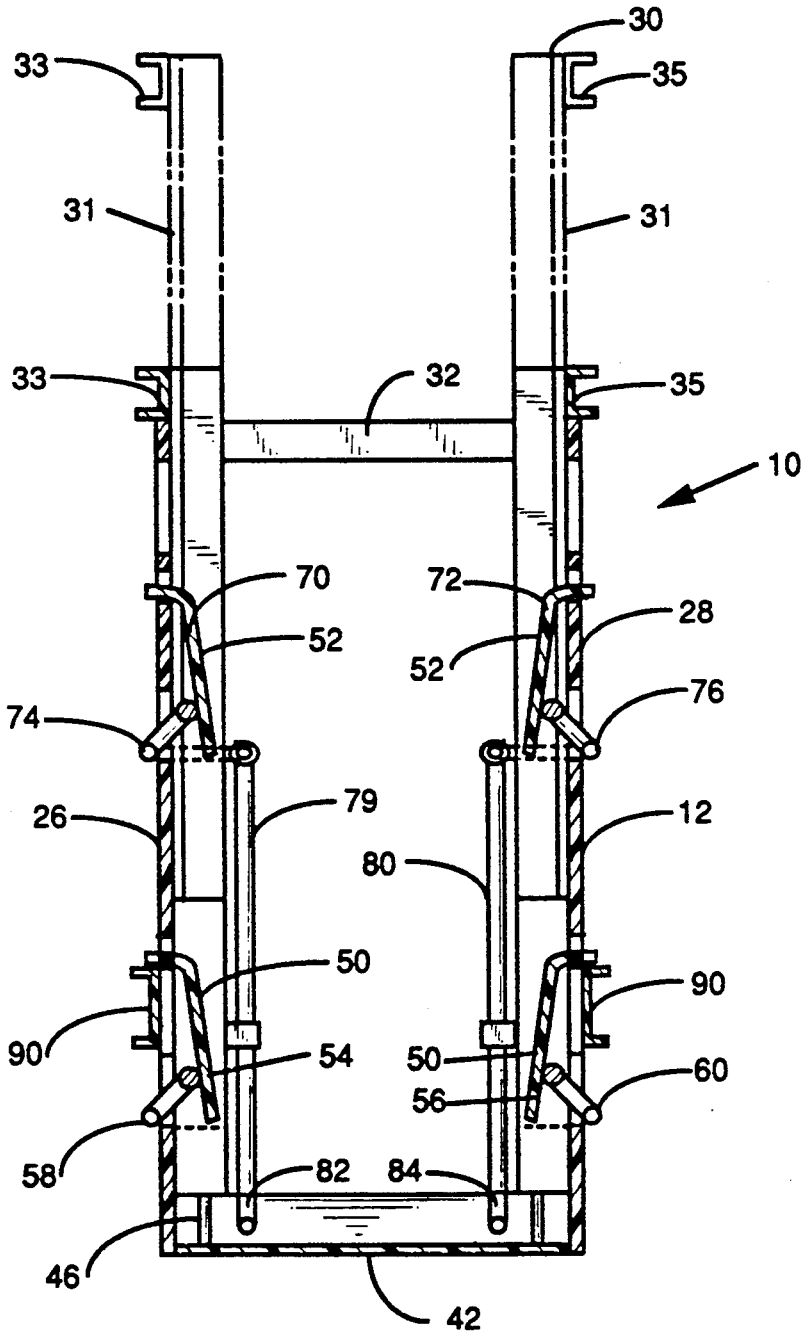
FIG. 4 is a horizontal section view through mid-section the sides of the assembly of FIG. 1 showing yet more details of construction.

Referring now to the drawings there is shown a pizza box storage and dispensing assembly 10 embodying the present invention. The assembly 10 includes an upright, hollow enclosure 12 of a generally rectangular cross-section shape having a back section 14 with an open mid-section and oppositely disposed side sections 16 and 18, a front section 20 also with an open mid-section and oppositely disposed side sections 22 and 24. The back section 14 and front section 20 are interconnected by oppositely disposed, similarly shaped left and right sidewalls 26 and 28, respectively. The overall size and shape of the enclosure 12 is such that standard size and commonly known, pizza boxes for use with prepared take-out pizzas, may be slidably received in their horizontal orientation within the enclosure. The top end of the enclosure 12 is open to directly receive pizza boxes or, as will be described hereinafter, to receive an extension enclosure 30. The back section 14, front section 20, and sidewalls 26 and 28, are secured to form the enclosure 12 by upper horizontally disposed bands 32 secured in place by any suitable means, such as nuts and bolts, rivets, or the like, and by a plate member 42 secured to the sidewalls, as will be described hereinafter. Also and as shown, the bands 32 may, without securing means, surround the upper sections of the side sections 16 and 18 and part of the sidewalls 26 and 28, and the side section 22 and 24 and part of the sidewalls and be removable therefrom.

A dispensing opening 40 is provided at the lower end of the enclosure 12 and through the front section 20 and between the left and right sidewalls 26 and 28. The dispensing opening 40 is dimensioned to permit grasping and withdrawal of a single pizza box therethrough. A generally planar plate member 42 is arranged within the lower portion of the enclosure 12 and extends at an inclination from the lower end of the dispensing opening 40 to the back section 14 into abutment with side sections 16 and 18. The plate member 42 is also in abutment with the inner surface of the left and right sidewalls 26 and 28, and is removably secured in place in clips 43 fixed on the inner surfaces of both sidewalls 26 and 28. The plate member 42 as secured in the clips 43, and the bands 32 may be simply removed and replaced by smaller or longer plate members 42 and bands 32 to vary the cross-sectional area of the enclosure 12 to thereby receive pizza boxes of different sizes. By allowing simple separation of the elements defining the enclosure 12, shipping, storage, and cleaning of the closure are made efficient and simple. As it is disposed, the plate member 42 serves as the closed lower end or bottom of the enclosure 12.

Secured to opposite side portions of the plate member 42 are riser members 48 and 46 having an upward portion extending slightly above the surface of the plate member. The riser members 48 and 46 serve to elevate the lowermost pizza box within the enclosure 12 above the surface of the plate member 42 and in so doing facilitates the withdrawal of the lowermost pizza box from the enclosure 12 through the dispensing opening 40.

An extension enclosure 30 may be telescopically, slidably received within the upper confines of enclosure 12. As with enclosure 12, extension enclosure 30 is hollow and of the same rectangular cross-section shape, but slightly smaller its peripheral dimensions to be snugly, yet slidably received within the enclosure 12. The extension enclosure 30 is open at both of its ends and sides, and may be positioned upwardly of the upper end of enclosure 12 to provide an increase of the overall pizza box storage space of the assembly 10. As shown, the extension enclosure 30, informed of four identically formed L-shaped corner sections 31, joined in pairs at the upper ends of their sides by braces 33 and 35. The corner sections 31 are slidably received under the raised lips of elongated, vertically extending, modified S-shaped strips 37 secured to the inner walls of the sidewalls 26 and 28. The corner sections 31 may also be secured as their fronts and rears so that they may be moved at a single unit.

First and second restraining means 50 and 52 are provided through the left and right sidewalls 26 and 28, and function together in response to the presence of the lowermost pizza box on plate member 42 and to the withdrawal of that same box to restrain pizza boxes above the lowermost box from downward movement prior to withdrawal of the lowermost pizza box and to release the restraint, allowing downward movement of the boxes, when the lowermost pizza box is withdrawn. Both first and second restraining means 50 and 52 are essentially the same in the manner of their functioning. The first restraining means 50 includes paddles or restraining plates 54 and 56 supported by the sidewalls 26 and 28 to pivot away from and toward the inner surfaces of the sidewalls. The restraining plates 54 and 56 are arranged to be urged pivotally inwardly by similarly arranged horizontally disposed rotatable rods 58 and 60 secured to the outer surfaces of sidewalls 26 and 28. The rods 58 and 60 are each provided with a U- or V-shaped extension located to abut the restraining plates 54 and 56, as shown. The rods 58 and 60 each have rear sections 61 and 63 at right angles to the main, side portions of the rods, the rear sections 61 and 63 arranged in abutment with the outer surface of the side sections 16 and 18 of back section 14. Helical coil springs 65 and 67 have their respective ends secured to openings in the side sections 16 and 18 and the free ends of rear sections 61 and 63 of the rods 58 and 60. The springs 65 and 67 provide biasing forces on the rods 58 and 60 to urge the restraining plates 54 and 56 pivotally inwardly of the enclosures 12. When the restraining plates 54 and 56 are urged inwardly the pizza boxes above the lowermost pizza box will be held against moving downwardly. When the lowermost pizza box is removed from the enclosure 12 weight of all of the pizza boxes remaining in the assembly 10 and the sidewardly directed force of the pizza boxes acting against the restraining plates 54 and 56 will be sufficient to overcome the restraining force of the springs 65 and 67 at the first restraining means 50 and move downwardly to deposit another pizza box on plate 42. The downward rotation of the rods 61 and 63 may be limited by brackets 59 and 61, open at this upper end to receive the rear sections 61 and 63. The springs 65 and 67 may be secured in different openings in the side sections 16 and 18 to vary their compression forces, as desired.

The removal of the lowermost pizza box from the assembly 10 will release the restraining force of the second restraining means 52, as will be described in detail hereinafter, and allow downward movement of all of the pizza boxes remaining in the assembly 10. The weight of all the pizza boxes above the first restraining means 50 and the sideward force of that weight acting against the restraining plates 54 and 56, would be sufficient to overcome the inwardly directed force on the restraining plates 54 and 56 to urge the plates outwardly toward the sidewalls 26 and 28 and allow downward movement of the pizza boxes. When both the first and second restraining means 50 and 52 are acting to hold the pizza boxes from downward movement, the lowermost box on plate no. 42 will not have the weight of all the pizza boxes acting on it and will therefore have no resistance against its removal from the assembly 10.

The second restraining means 52 is arranged above the first restraining means 50, and is responsive to the lowermost pizza box on and withdrawn from the enclosure 12 over plate 42. Second restraining means 52 includes similarly shaped, second paddles or restraining plates 70 and 72 arranged interiorly of and by sidewalls 26 and 28 to pivot toward and away from the inside of the sidewalls. Second rod members 74 and 76, each having a U- or V-shaped indentations in engagement with the inside of the second restraining plates 70 and 72, are rotatable and horizontally disposed to and secured to the sides to the sidewalls 26 and 28. Each rod member 74 and 76 has a rear section 77 and 78 at right angle to the rod members' main sections and in abutment with the side sections 16 and 18 of the back section 14. Vertical third rod members 79 and 80 are secured to the rear rod sections 77 and 78 and extend downwardly to lower rod sections 82 and 84 each of which extend at an inclination generally parallel to the planar surface of the inclined plate member 42. When the lowermost pizza box is on the plate member 42 a downward force is transmitted to the lower rod sections 82 and 84 and through the rear rod sections 79 and 80 to rotate the rod members 74 and 76 to urge restraining forces on the second restraining plates 70 and 72 to thereby cause the pizza boxes in contact with the plates 70 and 72 and above to be held against downward movement. When the lowermost pizza box is removed from the enclosure 12 the restraining force is removed from the second restraining plate 70 and 72 and the pizza boxes are free to move downwardly.

The first and second restraining means 50 and 52 together serve to restrain downward movement of the pizza boxes in contact with them as well as those above. By so restraining the downward movement of the pizza boxes, the force of the weight of the boxes is kept from the lowermost pizza box allowing unrestricted removal of the lowermost box from the enclosure 12.

The overall weight of the pizza box storage and dispensing assembly 10 may be made light enough for easy manual transportation thereof. Pizza boxes may be loaded into the assembly at one location and the filled assembly simply carried to another location for use. Handles 90 may be secured to the sidewalls 26 and 28 to facilitate carrying of the assembly 10.

Although the back section 14 and front section 20 have been described as separate sections of the assembly 10, they may be formed integrally with the sidewalls 26 and 28. The side sections 16 and 18, and side section 22 and 24 may simply be formed at right angles to the main sections of the sidewalls 26 and 28. An enclosure is needed to hold the pizza boxes in an orderly manner, and any number of arrangements are available to form such an enclosure.

It should now be clearly recognized how the pizza storage and dispensing assembly of this invention functions and the advantages its produces, as described in the introductory sections of the specification. It should also be now apparent that the overall structure of this invention may be changed or modified. One such change or modification, for example, would be to substitute a spring or other biasing arrangement for the rod arrangement of the first restraining means 50. It should also be noted that, in effect, that the first restraining means 50 is dependent upon the second restraining means 52 and the presence or absence of the lowermost pizza box on plate member 42. The weight of the pizza boxes above the restraining plates 70 and 72 add to the boxes below to urge the boxes at the restraining plates 54 and 56 downwardly forcing the restraining plates 54 and 56 inwardly. Yet other change and modifications would be apparent to these skilled in this art.

While I have shown and described a present preferred embodiment of this invention, it is to be distinctly understood that the invention is not limited thereto, but may be otherwise embodied within the scope of the following claims.

I claim:

1. A pizza box storage and dispensing assembly, comprising:

an upright, hollow enclosure of generally rectangular cross-section having an interconnected back section, sidewalls, front section, an upper end, and a lower end;

said back section, sidewalls, and front section of said enclosure being sized and shaped such that pizza boxes of predetermined rectangular or square sizes may be slidably received within said enclosures;

said front section of said enclosure defining a dispensing opening at the lower end of said enclosure dimensioned to permit grasping and withdrawal of a single pizza box therethrough;

a generally planar plate member fixed between lower portions of said sidewalls extending at an inclination from the lower end of said dispensing opening upwardly and rearwardly to a lower portion of said back section; and restraining means disposed inwardly at a generally horizontal plane through an intermediate portion of at least one of said sidewalls and responsive to the weight of a lowermost pizza box on said plate member for urging a force on pizza boxes above said lowermost pizza box for restraining downward movement of pizza boxes above the said horizontal plane and for releasing the restraining force upon withdrawal of said lowermost pizza box from said enclosure;

said restraining means including paddle members pivotally supported by the sidewalls, and interconnected rod members operative with said paddle members, wherein a section of each rod member is overlying and parallel to the surface of said plate member for engagement by said lowermost pizza box to transmit a force through said rod members to urge said paddle members inwardly of said sidewalls such that upon withdrawal of said lowermost pizza box from said enclosure said force is removed and said paddle members are urged toward said sidewalls

2. The pizza box storage and dispensing assembly as set forth in claim 1 including a pair of parallel elongated riser members fixed on side portions of said plate member for elevating a pizza box slightly above the surface of said plate member.

3. The pizza box storage and dispensing assembly as set forth in claim 1 including an upright hollow extension assembly of generally rectangular cross-section and of a configuration essentially the same as said enclosure, snugly slidably, and telescopically received interiorly of an upper portion of said enclosure and movable upwardly and downwardly of said enclosure.

4. The pizza storage and dispensing assembly as set forth in claim 1 wherein said restraining means as described is provided in each of said sidewalls.

5. The pizza storage and dispensing assembly as set forth in claim 1 wherein said plate member includes means removably operable with said sidewalls, back section and front section to secure the sidewalls, back section and front section.

6. The pizza storage and dispensing assembly as set forth in claim 5 including strap means removably secured to said sidewalls for securing said sidewalls in place.

7. A pizza box storage and dispensing assembly, comprising:

an upright, hollow enclosure of generally rectangular cross-section having an interconnected back section, sidewalls, front section, an upper end, and a lower end;

said back section, sidewalls, and front section of said enclosure being sized and shaped such that pizza boxes of predetermined rectangular or square sizes may be slidably received within said enclosure;

said front section of said enclosure defining a dispensing opening at the lower end of said enclosure dimensioned to permit grasping and withdrawal of a single pizza box therethrough;

a generally planar plate member fixed between lower portions of said sidewalls extending at an inclination from the lower end of said dispensing opening upwardly and rearwardly to a lower portion of said back section; and restraining means comprising: a pair of first paddle members, one each pivotally supported opposite each other by said sidewalls; biasing means operative with each of said first paddle members for urging said first paddle members inwardly of said sidewalls; a pair of second paddle members, each pivotally supported opposite each other by said sidewalls above said first paddle members; interconnected rod members operative with said second paddle members with sections of said rod members arranged adjacent the surface of said plate member for engagement by said lowermost pizza box to transmit a force through said rod members to urge said second paddle members inwardly of said sidewalls whereby pizza boxes at and above said second paddle members will be restrained against downward movement and such that upon withdrawal of said lowermost pizza box from said enclosure said force is removed and said second paddle members are urged toward said sidewalls permitting the pizza boxes to move downwardly within said enclosure; and said biasing means being such that the weight of the pizza boxes above said first paddle members will urge said first paddle members inwardly of said sidewalls allowing a single pizza box to move downwardly onto said plate member and into engagement with said sections of said rod members to transmit said force through said rod members to urge said second paddle members inwardly of said sidewalls to restrain said downward movement of pizza boxes at and above said second paddle members.

8. The pizza box storage and dispensing assembly as set forth in claim 7 including a pair of parallel elongated riser members fixed on side portions of said plate member for elevating a pizza box slightly above the surface of said plate member.

* * * * *